US005735257A

United States Patent [19]

Walk

[11] Patent Number: 5,735,257

[45] Date of Patent: Apr. 7, 1998

[54] MULTI-CHAMBER STABILIZER FOR ARCHERY BOWS

[75] Inventor: Randy J. Walk, Tooele, Utah

[73] Assignee: Hoyt USA, Salt Lake City, Utah

[21] Appl. No.: 596,435

[22] Filed: Feb. 2, 1996

[51] Int. Cl.[6] ..... F41B 5/20

[52] U.S. Cl. ..... 124/89; 188/378

[58] Field of Search ..... 124/89; 188/378, 188/380

[56] References Cited

U.S. PATENT DOCUMENTS

| | | | |
|---|---|---|---|
| 3,690,414 | 9/1972 | Aggarwal et al. | 188/378 |
| 4,570,608 | 2/1986 | Masterfield | 124/89 |
| 4,615,327 | 10/1986 | Saunders | 124/89 |
| 4,893,606 | 1/1990 | Sisko | 124/89 |
| 5,016,602 | 5/1991 | Mizek | 124/89 |
| 5,370,104 | 12/1994 | Neie | 124/89 |
| 5,487,375 | 1/1996 | McDonald | 124/89 |
| 5,511,533 | 4/1996 | Waller | 124/89 |

*Primary Examiner*—John A. Ricci
*Attorney, Agent, or Firm*—Mallinckrodt & Mallinckrodt

[57] ABSTRACT

An elongate stabilizer for an archery bow includes an elongate housing having a plurality of separate internal chambers suitable to receive damping material or damping devices therein. One end of the stabilizer may be mounted on a bow riser in normal manner. In a preferred embodiment of the stabilizer, separate chambers extend inwardly from opposite ends of the elongate housing and are closed by end pieces secured to the opposite ends of the housing. The chambers are separated by an intermediate portion of the housing. Damping material or devices may be contained in one or more of the chambers and when more than one chamber contains damping material or devices, such damping material or devices may be of different types.

20 Claims, 2 Drawing Sheets

MULTI-CHAMBER STABILIZER FOR ARCHERY BOWS

BACKGROUND OF THE INVENTION

1. Field

The invention is in the field of stabilizers for archery bows.

2. State of the Art

Stabilizers are often secured to an archery bow handle riser, usually extending from the front thereof, to help balance the bow, counteract torque developed during shooting of the bow, and to absorb shock and vibration upon shooting of the bow. Many stabilizers have elongate hollow housings closed at opposite ends to form an internal chamber. The internal chamber may be filled with a variety of materials such as oil or other viscous fluid, lead shot, glass beads, or a variety of plunger and resistance arrangements.

U.S. Pat. No. 4,570,608 shows an internal chamber filled with a viscous fluid, such as an automotive hydraulic brake fluid. A rod extends from the mounting stud into the fluid. Weight can be added to the outer end of the stabilizer, if desired.

U.S. Pat. No. 5,016,602 shows an internal chamber partially filled with granular solids such as sand, crushed stone, plastic particles, ceramic particles or metal particles. The particles can move within the chamber and absorb vibrations and other energy from the bow when shot.

U.S. Pat. No. 4,615,327 shows a stabilizer having two separate hollow stabilizer housings resiliently joined together to absorb vibration and energy from the bow. The resilient connecting mountings extend into the housing chambers and resilient material separates the two housings.

While many of the prior art stabilizers work satisfactorily, there is always an attempt to improve stabilizers to make them more effective and versatile.

SUMMARY OF THE INVENTION

According to the invention, a stabilizer includes an elongate housing having two or more separate chambers therein. In a preferred embodiment, there are two chambers which generally extend inwardly toward one another from opposite ends of the housing. Removable housing ends may be included to provide access to the respective chambers. The separate chambers may be of different sizes. The chambers may be left empty and the weight and weight distribution of the stabilizer will be effective in stabilizing a bow. One or both chambers of the stabilizer may be filled or partially filled with damping material such as a fluid or solid particles, or may have damping devices such as various piston arrangements or other shock absorbing devices for stabilization and energy absorption purposes. With the two separate chambers, different damping materials or devices may be placed in each chamber to customize and optimize the stabilizer for particular bows and shooting conditions. It has been found that in many cases a combination of damping materials or devices in the stabilizer provides better energy damping than a single type of damping means can.

In a preferred form of the invention, the separate chambers are separated by an intermediate portion of the elongate housing. The position of the intermediate portion of the housing may, if desired, be adjustable in the housing to adjust the sizes of the respective separate chambers. The stabilizer housing is secured to the bow handle riser in the normal manner, and may have weights attached to the outer end thereof in normal manner.

THE DRAWINGS

The best mode presently contemplated for carrying out the invention is illustrated in the accompanying drawings, in which:

FIG. 1 is a perspective view of an archery bow with a stabilizer of the invention secured thereto.

FIG. 2, an enlarged fragmentary vertical section taken on the line 2—2 of FIG. 1 showing the mounting of the stabilizer to the riser;

FIG. 3, a side elevation of a stabilizer of the invention removed from the bow;

FIG. 4, a side elevation of the stabilizer of FIG. 2 turned 90° about its longitudinal axis;

FIG. 5, a vertical section taken on the line 5—5 of FIG. 4 showing chambers of different dimensions;

FIG. 6, a vertical section of a stabilizer of the invention similar to that of FIG. 5, but with a different central portion and showing chambers of the same dimensions;

FIG. 7, an end elevation of the stabilizers of FIGS. 3–5;

FIG. 8, a vertical section of a stabilizer similar to that of FIG. 6, but drawn to a reduced scale, showing the chambers therein filled with stabilizing materials;

FIG. 9, a vertical section of a stabilizer similar to that of FIG. 6, but drawn to a reduced scale and showing differently sized chambers, with different stabilizing means in each chamber; and FIG. 10, a vertical section of a stabilizer similar to that of FIG. 6, but showing an embodiment of stabilizer with a position adjustable central portion.

DETAILED DESCRIPTION OF THE ILLUSTRATED EMBODIMENT

Figure 1:
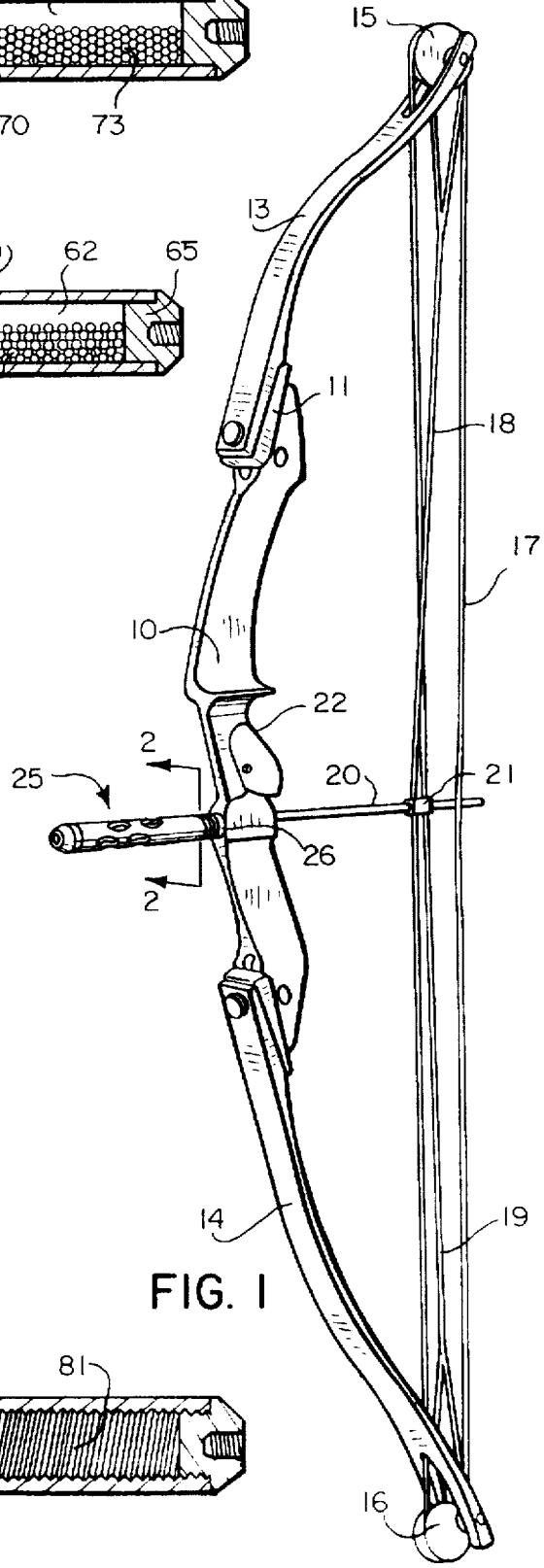

An archery bow generally includes a handle riser 10, FIG. 1, with means, here shown as upper and lower limb mounting pockets 11 and 12, respectively, to mount upper and lower limbs 13 and 14, respectively, to the respective ends of the handle riser 10. In a compound archery bow, wheels 15 and 16 are mounted for eccentric rotation at the ends of limbs 13 and 14, respectively, with bow string 17 extending between wheels 15 and 16. Buss cables 18 and 19 extend between respective wheels and opposite limb tips. A cable guide 20 extends from attachment to riser 10 with a cable retaining member 21 slidably mounted thereon. An archer grips the handle riser around a hand grip portion 22 formed in or secured to the handle riser 10. This is representative of standard compound archery bow construction. A recurve bow may be similarly constructed, but would not have the wheels 15 and 16 mounted on the ends of the limbs. Instead, a bowstring is connected directly between respective outer limb tips. Also, while the handle riser 10 is shown as a separate piece with limbs 13 and 14 attached thereto, and this is generally representative of modern compound and recurve bow construction, the handle riser and bow limbs could be formed integrally. Even with integral construction, however, the limbs can be considered as secured to and extending from the ends of the handle riser.

Figure 2:
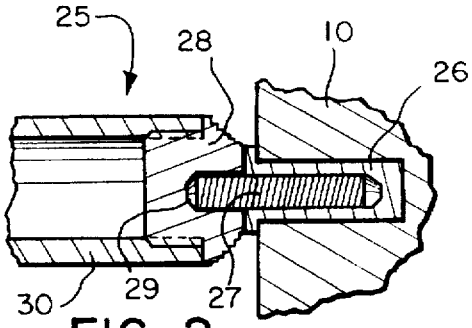

Most handle risers 10 provide for the removable mounting of a stabilizer, such as 25, to the riser in the general area as shown in FIG. 1, so that the stabilizer 25 extends in a direction away from the archer from the back of the bow (the side facing away from the bow string and archer. In the bow shown, an internally threaded insert 26, FIGS. 1 and 2, is securely positioned in riser 10 in any known manner. The stabilizer is secured to the bow by a threaded stud 27 which is screwed into insert 26. Stud 27 may be an integral part of the stabilizer extending from an end thereof or may be removably threaded into an internally threaded opening in an end of the stabilizer. As shown in FIG. 2, stabilizer 25 includes an end plug 28 having an internally threaded opening 29 therein. Stud 27 is screwed into both opening 29 and insert 26 to secure stabilizer 25 to riser 10.

Figure 3:
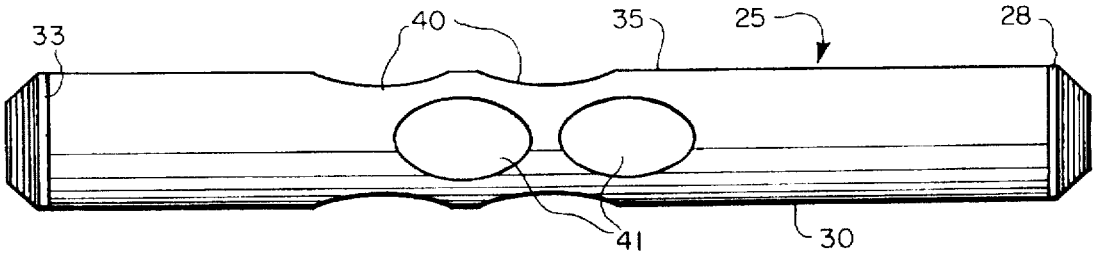
Figure 4:
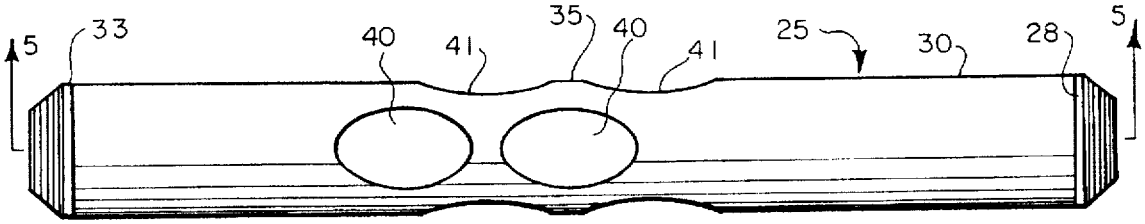
Figure 5:
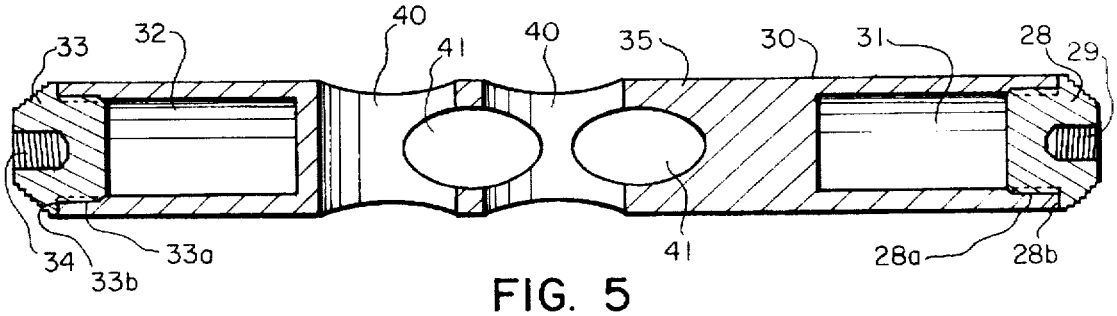

Stabilizer 25 of the invention includes an elongate housing 30, FIGS. 2–5, having a pair of internal, closed chambers 31 and 32, FIG. 5, therein. Chambers 31 and 32 extend inwardly toward one another from opposite ends of housing 30. Stabilizer end pieces in the form of end plugs 28 and 33 close the open ends of the chambers 31 and 32, respectively. Advantageously, the ends of the chambers at the opposite ends of the housing are internally threaded while end plugs 28 and 33 have externally threaded portions **28*a* and 33*a* that are screwed into the ends of the chambers. End plugs 28 and 33 also preferably include intermediate shoulders 28*b* and 33*b* which can be tightened against the ends of housing 30** to securely hold the end plugs in place.

As previously indicated, plug 28 has an internally threaded opening 29 which can receive an end of a threaded stud such as 27, FIG. 2, to secure the stabilizer to a bow riser. End plug 33 has a similar internally threaded opening 34. This can receive a stud for attachment of that end of the stabilizer to a riser. Thus, the stabilizer may be secured to a bow riser at either end of the stabilizer. In addition, when one end of the stabilizer is secured to a bow riser, an additional standard weight or extender may be attached to the opposite end of the stabilizer in normal manner to extend therefrom.

Figure 6:
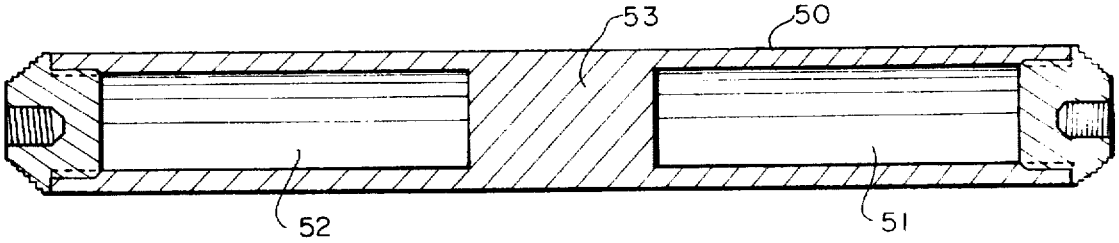
Figure 7:
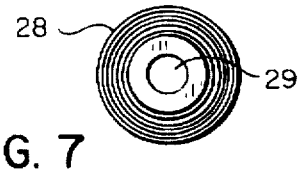

As shown by FIG. 5, chambers 31 and 32 extend from opposite ends of housing 30 toward one another, but remain separated by an intermediate portion 35 of housing 30 which separates the chambers 31 and 32 so that they remain two distinct and separate chambers. The intermediate portion can remain solid, as shown in FIG. 6, or can be cut away in various manners to adjust the appearance of the stabilizer. These cut aways may take the form of holes of various shapes formed through the intermediate portion or of indentations or recesses of various configurations formed in the housing. The stabilizer of FIGS. 1 and 3–5 include two sets of elliptically shaped holes 40 and 41 extending through intermediate portion 35. The presence of the holes, their elliptical shape, and the specific arrangement of the two sets of holes rotated 90° from one another are merely for aesthetic reasons to give the stabilizer an unique appearance. In the embodiment of FIGS. 3–5, the holes are closer to one end than to the other. Generally the shorter end will be the end attached to the bow riser to put more of the weight of the stabilizer away from the bow. However, the holes could be centered with respect to the stabilizer or, as mentioned, either end of the stabilizer could be secured to the bow riser.

In the embodiment of stabilizer shown in FIGS. 3–5, the chambers 31 and 32 are of different sizes, chamber 31 being larger (longer) than chamber 32. The stabilizer may, however, have chambers of equal sizes. FIG. 6 shows a stabilizer having housing 50 with equal size chambers 51 and 52. Intermediate housing portion 53 is solid without holes or indentations.

The chambers, 31 and 32 of FIG. 5 or 51 and 52 of FIG. 6, may be left empty during use of the stabilizer. The stabilizer, because of its weight and length will act to stabilize the bow in normal manner. If desired, either or both chambers can be filled with any of the conventional damping materials such as a viscous fluid or lead shot or other granular materials such as glass beads or sand. Further, any of a variety of conventional damping devices, such as piston devices, can be sized to fit into one or both of the chambers. A particular advantage of the stabilizer of the invention is that different damping materials may be placed in the different chambers of the stabilizer to optimize the damping desired by an archer for a particular bow. For example, chamber 31 could be filled with glass beads while chamber 32 could be filled or partially filed with sand. Chamber 31 could have a piston damping system therein while chamber 32 is filled with lead shot and oil. Any desired damping medium or combination of mediums can be used. End plugs 28 and 33 with shoulders **28*b* and 33*b*** tightly abutting the respective ends of the housing, are generally sufficient to keep a viscous fluid, such as oil, from leaking from the chambers, however, gaskets could be used to provide a fluid tight seal.

Figure 8:
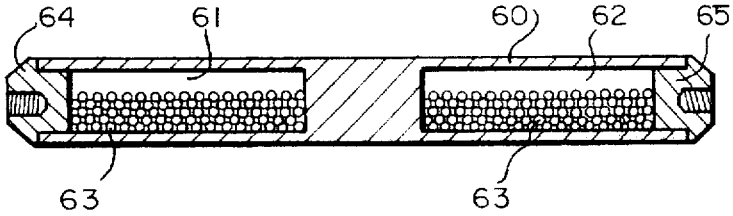

FIG. 8 shows a stabilizer similar to that of FIG. 6 with stabilizer body 60 and equally sized chamber 61 and 62. Lead shot 63 partially fills each of the chambers 61 and 62. In addition to the lead shot 63, the chambers could also be filled with oil or other fluid to fill the voids between the shot. The same damping material can be provided in each compartment of the stabilizer. The stabilizer end pieces 64 and 65, rather than being threaded and screwed into the ends of the stabilizer body, can be sized for a tight friction (press) fit, or may be glued into place using various adhesives to securely hold them in place, and to seal them to the stabilizer body if a fluid is placed in a compartment. The illustrated exterior step configuration of the end pieces is provided merely for appearance purposes and smooth sloping or other surfaces may be used.

Figure 9:
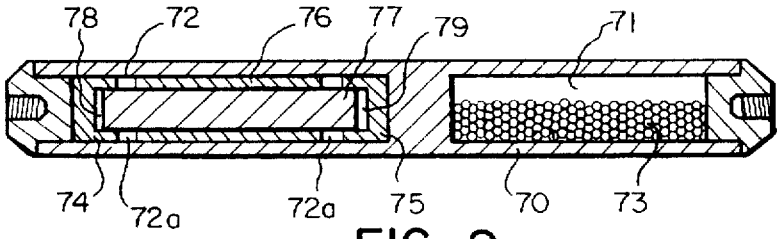

If desired, as shown in FIG. 9, different damping means can be provided in each of the compartments. This is one of the advantages of the present invention. FIG. 9 shows a stabilizer similar to that shown in FIGS. 6 and 8, but with different size compartments. Thus, stabilizer body 70 includes compartments 71 and 72, with compartment 72 of somewhat larger size (longer) than compartment 71. Compartment 71 is shown filled with lead shot 73 and oil as described for the stabilizer of FIG. 8 although various other energy absorbing materials or devices could be used. Compartment 72 shows a piston damping arrangement and includes foam end caps 74 and 75 positioned in the end portions of chamber 72 and foam sleeve 76 positioned in the central portion of chamber 72. The ends of sleeve 76 are generally spaced from the end caps to form spaces **72*a* therebetween. A plunger or piston 77, generally of a metal, is slidably positioned in sleeve 77 with end portions thereof extending slidably into cylindrical bores 78 and 79 in end caps 74 and 75. The plunger 77 is shorter than the length between the ends of cylindrical bores 78 and 79 so that plunger 77** has room to slide in the chamber. This movement of the plunger acts to absorb energy and vibration when the bow is shot. Various other damping arrangements could be used rather than the plunger arrangement shown. The point being that with multiple chambers in the stabilizer, different damping materials or devices may be used in each compartment.

Figure 10:
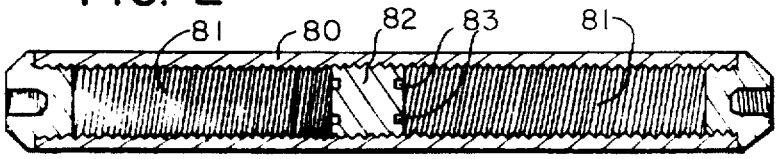

FIG. 10 shows a stabilizer with two chambers of adjustable size. Stabilizer body 80 has an internally threaded central bore 81 extending the entire length of the body. A plug 82 is threaded into the bore to form the intermediate portion of the housing separating the two chambers and by turning the plug 82, it can be positioned as desired along the length of the bore to divide bore 81 into chambers of adjustable relative size. Holes 83 in the end of the plug allow insertion of a tool for rotating the plug within the stabilizer body.

Generally the stabilizer of the invention will have two chambers therein, such chambers extending from opposite ends of the housing and being closed with chamber end pieces such as the various end plugs shown. Various type of end pieces could be used, such as end caps rather than the end plugs. Further, additional chambers could also be provided. For example, one or more of the holes 40 or 41 could have plugs at each end to serve as additional chambers and hold damping material, if desired. Such holes could be formed so they do not extend completely through the housing to thereby form one closed end, and, if that hole is circular in cross section, a plug could be threaded into or otherwise secured in the open end of the hole to seal the open end and provide the additional closed chambers. Various other configurations could be used for one or more additional chambers such as making the housing in two pieces which screw together intermediate the ends of the housing with a third chamber formed where the pieces come together.

The stabilizer may be made of various materials, such as aluminum or other metals, or composite or plastic materials, or combinations thereof. When the housing is made of metal, such as aluminum, the chambers and any desired holes may be drilled or machined into the metal. Various other materials may be molded to shape or formed in other known manner. The stabilizer may also be of various sizes. An aluminum housing, with aluminum end plugs to provide a stabilizer about nine and one-half inches long and weighing eleven ounces with empty chambers has been found effective.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A stabilizer for an archery bow, comprising:

an elongate housing having opposite ends;

means at one end of the housing for mounting the housing to an archery bow riser;

a plurality of separate internal chambers within the elongate housing, each chamber configured to accept damping means therein; and damping means of different types in at least two of the plurality of separate internal chambers.

2. A stabilizer for an archery bow according to claim 1, wherein one separate chamber extends inwardly from one end of the housing and another separate chamber extends inwardly from the opposite end of the housing.

3. A stabilizer for an archery bow according to claim 2, wherein the chambers extending inwardly from opposite ends of the housing are separated by an intermediate portion of the housing to form two separate chambers.

4. A stabilizer for an archery bow according to claim 3, wherein two separate chambers are formed in the housing.

5. A stabilizer for an archery bow according to claim 4, including housing end pieces secured at the opposite ends of the housing to close the chambers.

6. A stabilizer for an archery bow according to claim 5, wherein the end pieces are removably secured to opposite ends of the housing.

7. A stabilizer for an archery bow according to claim 5, wherein the means for mounting the housing to an archery bow is included in one of the end pieces.

8. A stabilizer for an archery bow according to claim 3, wherein the two separate chambers extending inwardly from opposite ends of the housing are of equal size.

9. A stabilizer for an archery bow according to claim 3, wherein the two separate chambers extending inwardly from opposite ends of the housing are of unequal size.

10. A stabilizer for an archery bow according to claim 3, wherein the position of the intermediate portion of the housing separating the chambers is adjustable, whereby the relative sizes of the chambers are adjusted by adjusting the position of the intermediate portion.

11. A stabilizer for an archery bow according to claim 1, wherein at least two chambers of the plurality of separate internal chambers are of equal size.

12. A stabilizer for an archery bow according to claim 1, wherein at least two chambers of the plurality of separate internal chambers are of unequal size.

13. A stabilizer for an archery bow, comprising:

an elongate housing having opposite ends;

means at one end of the housing for mounting the housing to an archery bow riser;

a first internal chamber extending inwardly from one end of the housing;

a separate second internal chamber extending inwardly from the opposite end of the housing, said first and second chambers being separated by an intermediate portion of the housing and being of unequal size.

14. A stabilizer for an archery bow according to claim 13, including housing end pieces secured at the opposite ends of the housing to close the chambers.

15. A stabilizer for an archery bow according to claim 14, wherein the end pieces are removably secured to opposite ends of the housing.

16. A stabilizer for an archery bow according to claim 14, wherein the means for mounting the housing to an archery bow is included in one of the end pieces.

17. A stabilizer for an archery bow according to claim 13, additionally including dampening means in at least one of the separate internal chambers.

18. A stabilizer for an archery bow according to claim 13, additionally including damping means in the two separate internal chambers.

19. A stabilizer for an archery bow, comprising;

an elongate housing having opposite ends;

means at one end of the housing for mounting the housing to an archery bow riser; and a plurality of separate internal chambers within the elongate housing, each chamber configured to accept damping means therein;

wherein at least two chambers of the plurality of separate internal chambers are of unequal size.

20. A stabilizer for an archery bow, comprising:

an elongate housing having opposite ends and an internally threaded bore extending therethrough;

means at one end of the housing for mounting the housing to an archery bow riser;

an externally threaded intermediate housing portion threaded into the internally threaded bore of the housing to divide the bore of the housing into two separate chambers, each chamber extending inwardly from an end of the housing;

whereby rotation of the intermediate housing portion causes movement of the intermediate portion within the threaded bore to adjust the relative sizes of the chambers.

* * * * *